US005624046A

United States Patent [19]

Zimmermann

[11] Patent Number: 5,624,046

[45] Date of Patent: Apr. 29, 1997

[54] TELESCOPIC RODS FOR A CRANE

[76] Inventor: Horst Zimmermann, Suchardstrasse 23, A-6700 Bludenz, Austria

[21] Appl. No.: 388,808

[22] Filed: Feb. 15, 1995

[30] Foreign Application Priority Data

Mar. 18, 1994 [AT] Austria ..... 576/94

[51] Int. Cl.[6] ..... B66C 23/04; B65B 63/04

[52] U.S. Cl. ..... 212/349; 212/230; 212/264; 52/118; 52/632

[58] Field of Search ..... 212/296, 199, 212/202, 203, 230, 231, 264, 347–350; 52/118, 632, 115, 116

[56] References Cited

U.S. PATENT DOCUMENTS

| | | | |
|---|---|---|---|
| 2,819,803 | 1/1958 | Obenchoin | 212/264 |
| 3,398,492 | 8/1968 | Nansel | 212/349 |
| 3,842,985 | 10/1974 | Suede | 212/264 |
| 4,492,311 | 1/1985 | Rathe | 212/231 |
| 4,664,272 | 5/1987 | Mentzer . | |

FOREIGN PATENT DOCUMENTS 1569315 6/1980 United Kingdom .

OTHER PUBLICATIONS

Soviet Inventors Illustrated Sections P.Q: General/Mechanical issued Jun. 17, 1987: "Telescopic crane jib—has sprung locking pins with L–shaped levers and cable system for interlocking" Odess Heavy Crane (Jan. 28, 1985–SU–847236).

*Primary Examiner*—David A. Bucci
*Assistant Examiner*—R. B. Johnson
*Attorney, Agent, or Firm*—Friedrich Kueffner

[57] ABSTRACT

A telescopic rod composed of a plurality of tubular rod sections which are mounted so as to be slidable within each other includes a multistage piston-cylinder unit which is arranged within the telescopic rod and is connected to the outermost rod section of the telescopic rod and to the last inner rod section of the telescopic rod. Locking bars are provided in the areas of the inner end faces of individual sections, wherein the locking bars are displaceable in a direction transversely of the longitudinal direction of the rod sections and wherein the locking bars can be placed in operative engagement with the respectively adjacent outer rod section. When the rod sections of the telescopic rod are in the extended end position, the locking bar of each inner rod section engages in a positively locking manner in an opening of the respectively outer adjacent rod section. Spring-biased clamps are provided on the outer sides of the rod sections located between the outermost rod section and the innermost rod section. When the telescopic rod is pushed together, the clamps grasp in a positively engaging manner bolts arranged at the end faces of the inwardly following rod sections.

10 Claims, 3 Drawing Sheets

TELESCOPIC RODS FOR A CRANE

BACKGROUND OF THE INVENTION

1. Field of the Invention

The present invention relates to a telescopic rod composed of a plurality of tubular rod sections which are mounted so as to be slidable within each other. The telescopic rod further includes a, possibly multistage, piston-cylinder unit which is arranged within the telescopic rod and is connected, on the one hand, to the outermost rod section of the telescopic rod and, on the other hand, to the last inner rod section of the telescopic rod. Locking bars are provided in the areas of the inner end faces of individual sections, wherein the locking bars are displaceable in a direction transversely of the longitudinal direction of the rod sections and wherein the locking bars can be placed in operative engagement with the respectively adjacent outer rod section. When the rod sections of the telescopic rod are in the extended end position, the locking bar of each inner rod section engages in a positively locking manner in an opening of the respectively outer adjacent rod section.

2. Description of the Related Art

Telescopic rods of the above-described type are used, for example, as telescopic jibs in a vehicle crane or rail crane, as a jib of a truck loading crane or as a telescope arm of a work platform, etc. The telescopic rod has an outer rod section and a plurality of telescoping inner rod sections. The outer rod section and the inner rod sections have a box-shaped cross section with flanges and webs, or the rod sections may also be produced from a tubular section. The device for pushing out the rod sections, usually a multistage piston-cylinder unit, is connected to the outermost rod section and the innermost rod section. In known embodiments of telescopic jibs, the device for pushing out the rod sections is fastened in fastening points at the individual sections of the parts to be telescoped. As a result, the individual cylinders or cylinder stages or the bolted connection of the outer telescope parts produce the sequence of pushing out the individual sections. Nevertheless, as is known in truck loading cranes, there is the arrangement of pushing elements mounted at the periphery of the outermost section. These embodiments are very complicated. This is true with respect to equipping individual cylinders as well as the corresponding hoses, screw connections, pipes and the respective fastening points. In addition, these embodiments are located outside of the two-axle neutral spring and, therefore, are subjected to extremely high loads when imperfections occur. The lateral free space required for these embodiments leads to additional structural limitations. These complicated constructions and embodiments are necessary for pushing the individual sections in or out in a certain sequence.

SUMMARY OF THE INVENTION

Therefore, it is the primary object of the present invention to provide a telescopic rod of the above-described type which is constructed in such a way that, when a simple pushing device is used which is only connected to the outermost rod section and the innermost rod section, a clearly defined sequence of movement of the individual rod sections is produced, such that the individual rod sections can be moved in or out successively. This is to be achieved inexpensively and in a structurally simple manner.

In a telescopic rod known from Soviet Inventions Illustrated Section Q, Week 8718, Jun. 17, 1987, Derwent Publications Ltd., London, Q 38, SU 1255-555 A, a pin is provided at the sections of the jib and these pins lock the extended sections of the jib relative to each other. Each of these pins is connected to a L-shaped pivotable lever at one end of which is provided a freely rotatable rope pulley. A cable is guided over the rope pulleys of the individual levers, wherein the cable can be wound onto a motor-driven drum which, in turn, is rotatably mounted on the outer section having the largest diameter. When the individual sections are fully extended relative to each other, the pins or bolts engage in openings of the respectively adjacent section, so that the individual sections are mechanically locked relative to each other. In order to retract the extended jib, initially the above-mentioned cable is wound onto the motor-driven drum, so that the shortening of the cable causes the L-shaped levers to be pivoted and, thus, the pins are pulled back from their locking positions. A control of the moving sequence of the individual sections is not provided and is not possible in this device.

A telescopic rod known from British patent 1,569,315 has a plurality of rod sections which are mounted so as to be slidable within each other. The individual rod sections can be locked relative to each other in the extended state as well as in the retracted state. The locking bolts provided in this telescopic rod are actuated by means of piston-cylinder units which, in turn, are externally controlled. This known telescopic rod is of very complicated construction.

In order to be complete, the indicating device according to U.S. Pat. No. 4,664,272 shall be mentioned. The device is mounted on a telescopic rod composed of a plurality of rod sections which are slidable within each other. Locking bolts are also provided for locking the individual rod sections relative to each other. In order to enable the crane operator to determine reliably whether the locking bolt has assumed its correct position of operation, an indicator is provided at the jib which is readable and visible from the crane operator cabin. The indicator is directly mechanically connected to the locking bolt and the locking bolt can only actuate the indicator when the locking bolt is in its locking position. This device is not suitable for controlling the moving sequence of the individual rod sections.

In accordance with the present invention, the above-mentioned object is met by providing the locking bars at the end faces of the rod sections located between the outermost rod section and the innermost rod section. Catches which hold the locking bars in the unlocked position when the telescopic rod is pushed together are arranged on the inner end faces of those rod sections which follow toward the inside the rod sections which have locking bars. Spring-biased clamps are provided on the outer sides of the rod sections located between the outermost rod section and the innermost rod section. When the telescopic rod is pushed together, the clamps grasp in a positively engaging manner bolts arranged at the end faces of the inwardly following rod sections. The individual clamps are held in locking position by means of a spring-biased locking bolt each of which is arranged at the end face of the outer rod section located adjacent the rod section with the clamps.

The configuration according to the present invention ensures that, when the telescopic rod is extended, initially the rod sections with gradually decreasing diameter are successively pushed out, while, when the telescopic rod is pushed together, the rod sections with gradually increasing diameter are successively pushed in.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
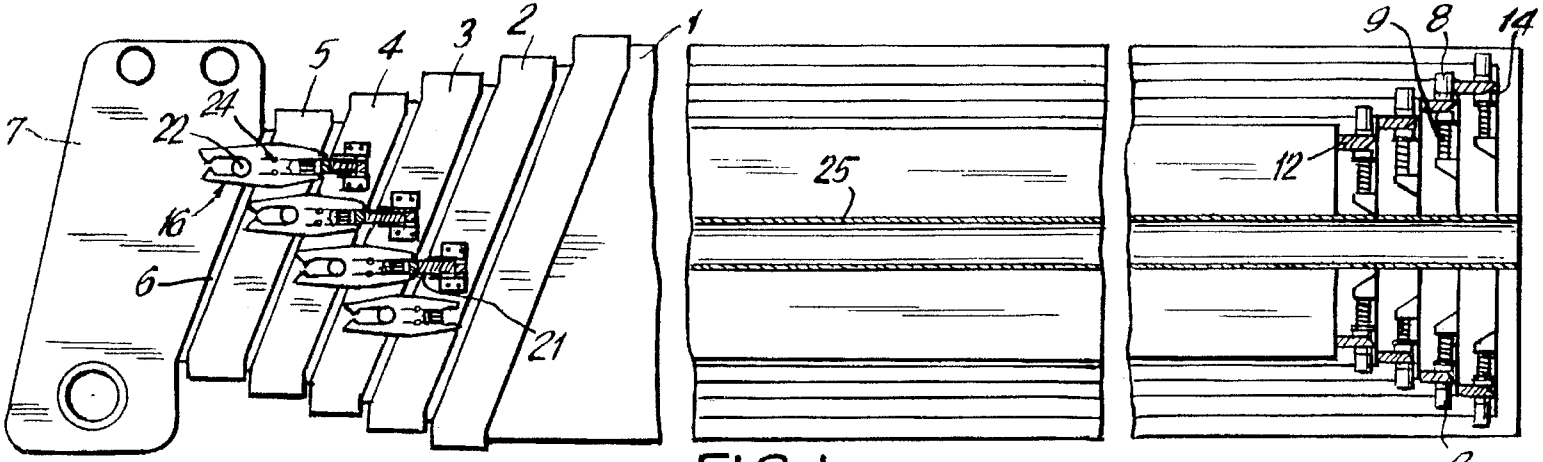
FIGS. 1 through 4 are side views, partially in section, of the telescopic rod according to the present invention, showing different stages of extending the telescopic rod.

In the illustrated embodiment, the telescopic rod according to the present invention has a plurality of successive tubular rod sections 1, 2, 3, 4, 5, 6. The tubular rod section 1 is the outermost rod section which is connected to a device for extending the telescopic rod. This device may be a multistage piston-cylinder unit 25, schematically illustrated in FIGS 1 to 4. The innermost rod section is rod section 6 which is also connected to the device for extending the telescopic rod. The device for extending the telescopic rod, not shown, is arranged in the interior of the telescopic rod. The innermost rod section 6 supports a head 7 on which a work unit may be arranged.

Figure 4:
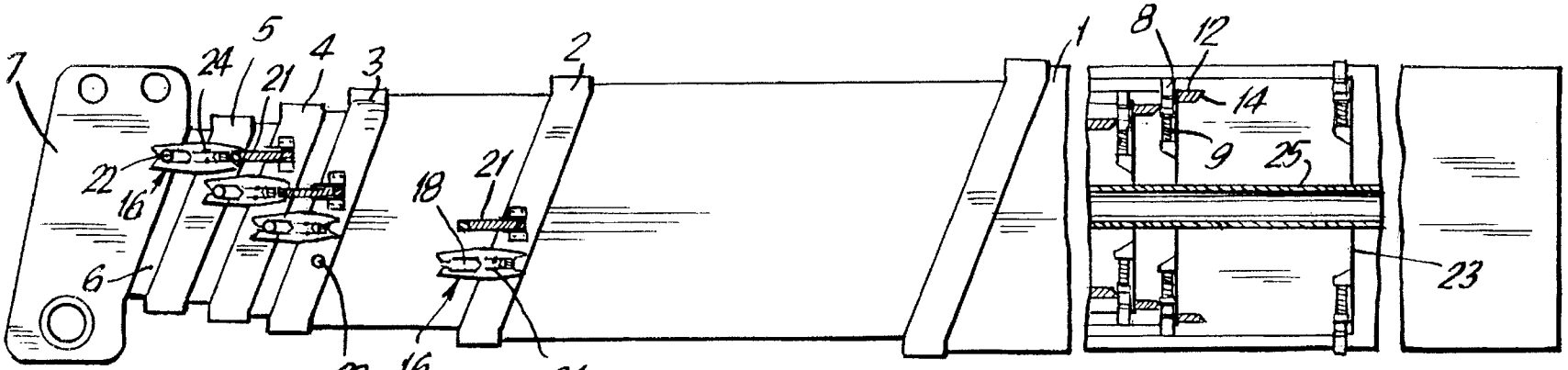
Figure 5:
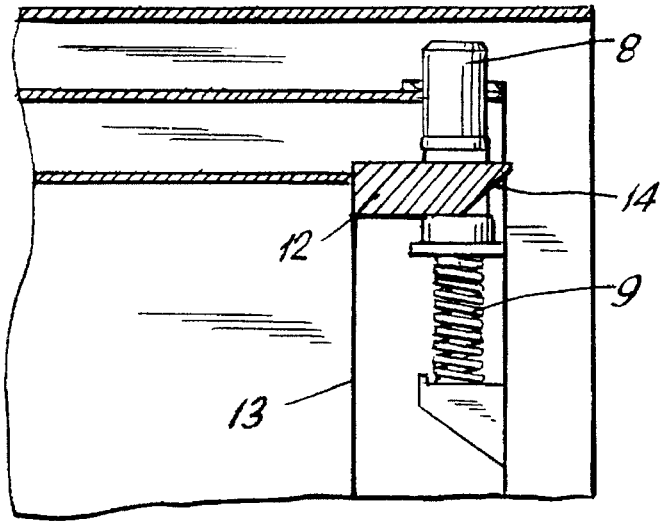
FIGS. 5 and 6 are detail views of the telescopic rod, on a larger scale, showing a locking bar in two different positions of operation.

Locking bars 8 are provided at the inner end faces 23 of the rod sections 2, 3, 4 and 5. The locking bars are arranged in pairs and diametrically opposite each other. The locking bars 8 are mounted so as to be displaceable transversely of the axial direction of the rod sections and the locking bars 8 are supported by a spring 9. The locking bars 8 provided in pairs for each rod section are advantageously located in the neutral zone of the telescopic rod, that is in a plane which extends perpendicularly of the drawing plane of FIGS. 1–4. However, the illustration of the drawing is selected for clarity's sake. The bolt-like locking bars 8 extend through the wall of the rod section on which they are mounted, and the locking bars 8 have a rear abutting surface 11 which interacts with a catch 12 which is arranged at the inner end face 13 of the respectively next following rod section, as shown in FIG. 5. The catch 12 is composed of a tongue which is arranged parallel relative to the axis of the rod section and is provided with an inclined surface 14 at the front end.

Figure 6:
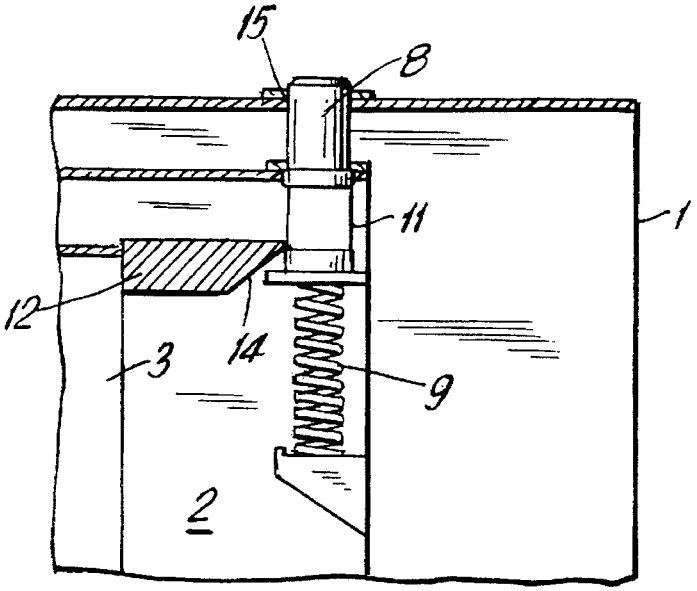
Figure 7:
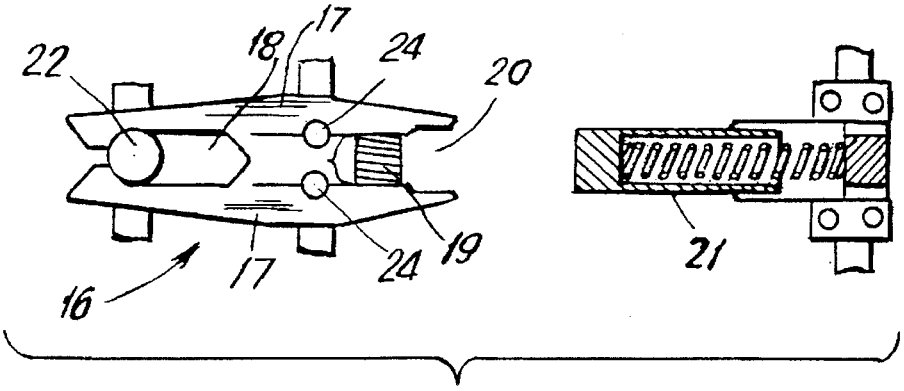
FIG. 7 is an exploded view showing a clamp and a locking bolt.

When the telescopic rod is pushed together, as shown in FIGS. 1 and 5, the catches 12 engage in the locking bars 8 and hold the latter in the unlocked position, as shown in FIG. 5. The locking bars 8 have such a length and their axial displacement distance has such a size that, when they are released by the catches 12, they rest against the inner wall of the adjacent outer rod section under the influence of the force of the pretensioned spring 9. When two adjacent rod sections are in their extended end positions, as shown in FIG. 6, the locking bar 8 of the respectively inner rod section is in alignment with an opening 15 in the wall of the adjacent outer rod section, wherein, as shown in FIG. 6, the locking bar 8 is pushed into the opening as a result of the force of pretensioned spring 9.

Clamps 16 are arranged at the outer end faces of the rod sections 2–5 which are arranged between the innermost rod section 6 and the outermost rod section 1. Each clamp 16 is composed of a pair of two-armed jaws 17 which are arranged symmetrically relative to each other and are each provided with an axis of rotation 24. The two portions of the jaws 17 projecting toward the endface of the respective rod section define an oblong recess 18 which extends in axial direction of the rod sections. A compression spring 19 is provided between the portions of the jaws 17 facing the adjacent outer rod section. The compression spring 19 holds the jaws 17 or the clamp 16 in the closed position. The latter portions of the jaws 17 also define a recess 20 which is open toward the adjacent outer rod section. A locking bolt 21 is arranged at the end face of the adjacent outer rod section and in alignment with the respective clamp 16. The locking bolt 21 extends parallel to the axial direction of the rod sections and is biased by a spring. In the illustrated embodiment, such locking bolts 21 are provided on the rod sections 2, 3 and 4. In addition, bolts 22 are fastened to the outer end faces of the rod sections 3, 4, 5 and 6. These bolts 22 are arranged in such a way that, when the rod sections are pushed into each other as shown in FIG. 1, the bolts 22 are received by the oblong recess 18 of a clamp 16.

In the following, the manner of operation of the telescopic rod according to the present invention shall be explained, starting from the position of the rod sections shown in FIG. 1 which shows the retracted telescopic rod. In this position, all catches 12 are moved into the locking bars 8 and hold the locking bars 8 in the unlocking position shown in FIG. 5. The bolts 22 of all rod sections are in the oblong recesses 18 of the clamps 16 on the right hand side as seen in the figures of the drawing.

Figure 2:
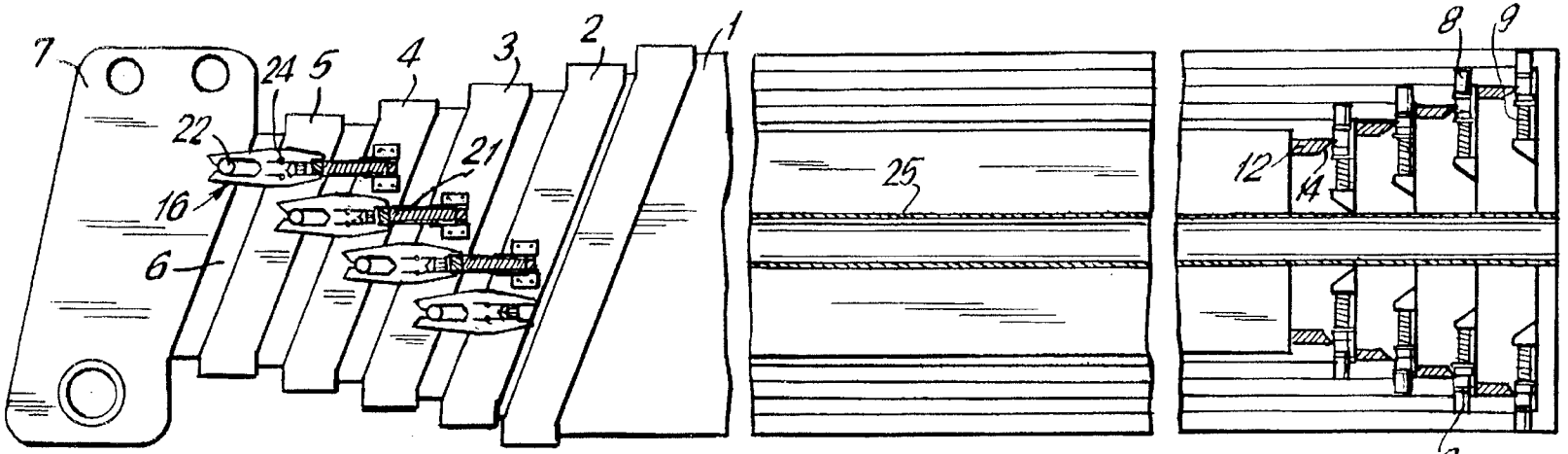
Figure 3:
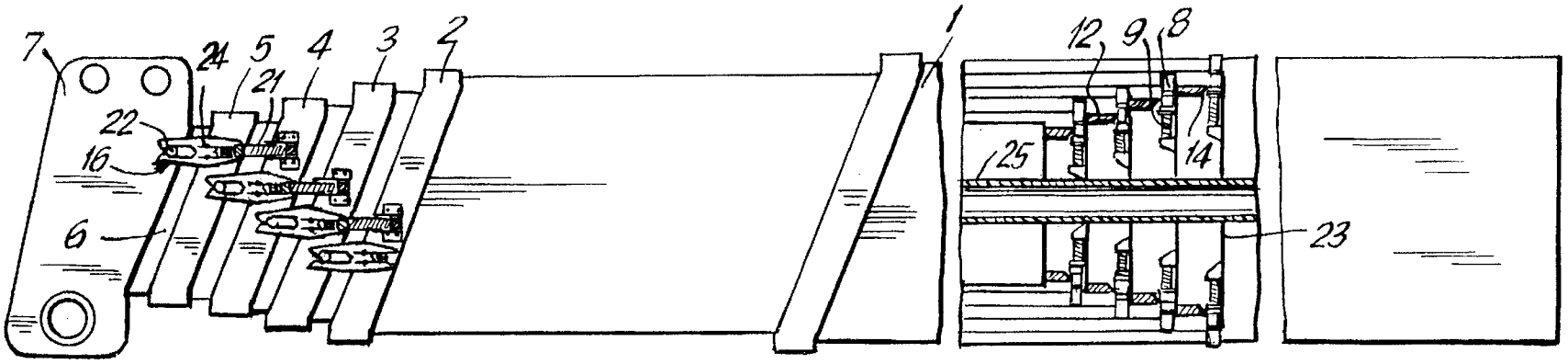

When the device for pushing out the rod sections acting on the innermost rod section 6 is activated, the rod sections are initially pushed out by the dimension corresponding to the inner length of the oblong recesses 18, as shown in FIG. 2. Simultaneously, the catches 12 are disengaged from the locking bars 8 which are now pushed by the force of the pretensioned spring 9 against the inner wall of the respectively adjacent outer rod section, as also seen in FIG. 2. The compression spring 19 of the clamp 16 of the second rod section 2 following the outermost rod section 1 is dimensioned in such a way that it produces a force which corresponds to the maximum force resulting from the friction resistances including a safety margin. The other clamps 16 are initially blocked by the locking bolts 21 which engage in the clamps 16. Consequently, the rod section 2 is now fully extended relative to the rod section 1 until the locking bar 8 at the inner end face 23 of the rod section 2 is in alignment with the opening 15 in the wall of the rod section 1, so that the locking bar 8 of the rod section 2 is pushed into the opening 15 as a result of the force of the pretensioned spring 9 acting on the locking bar 8 and, thus, the two rod sections 1 and 2 are locked relative to each other in axial direction, as seen in FIG. 3.

By further extending the device for pushing out the rod sections, the bolt 22 at the end face of the subsequent rod section 3 is pushed out of the clamp 16 of the rod section 2, so that the rod section 3 can then be extended relative to rod section 2 over the full length thereof. Simultaneously, the locking bolt 21 provided at the end face of the rod section 2 releases the clamp 16 of the rod section 3, as shown in FIG. 4, so that the above-described sequence of movements is now repeated between the rod sections 2 and 3 until the rod section 3 is fully extended relative to the rod section 2, wherein the two rod sections 2 and 3 are then secured relative to each other in axial direction by means of the locking bar 8 provided at the inner end face of rod section 2. This sequence of movements is now repeated between successive rod sections until all rod sections are fully extended. In that position, the innermost rod section 6 is held by the device for pushing out the rod sections, while all other rod sections 1 through 5 are blocked against axial displacement by means of the locking bars 8.

When the rod sections are later retracted, either by means of the device for pushing out the rod sections or by a separate return device, initially the innermost rod section 6 supported by the device is moved against the rod section 5 which is secured against axial displacement, wherein the bolt 22 at the end face of the innermost rod section 6 is moved into the clamp 16 at the end face of the rod section 5 and, subsequently, the catch 12 arranged at the inner end face 23 of the innermost rod section 6 pulls the locking bar 8 of the rod section 5 into its release position from the opening 15 in the wall of the rod section 4. The rod section 5 is now essentially suspended by means of its clamp 16 on the bolt 22 of the innermost rod section 6 supported by the device for pushing out the rod sections and the two rod sections 6 and 5 which are now connected again by the clamp 16 are moved further toward the right, wherein this above-described sequence of movements is repeated between rod section 5 and rod section 4 and this sequence of movements is continued to be repeated until all rod sections have been fully retracted into the position shown in FIG. 1. When the rod sections are pushed together in pairs, the locking bolts come again into operation which successively block the clamps 16.

The telescopic rod according to the present invention which, as mentioned above, may serve as a jib of a crane or the like, usually can be raised and pivoted about a horizontal axis and can be rotated and turned about a vertical axis. The individual tubular rod sections 1 to 6 usually have a box-shaped cross section. In the illustrated embodiment, the locking bars 8 are mechanically actuated by means of the tongue-like catches 12. It is within the scope of the present invention to use electrical, hydraulic or pneumatic actuating units for the locking bars 8.

The configuration of the telescopic rod according to the present invention makes it possible to fully utilize the telescopic rod with respect to its load-bearing capacity because always those rod sections are extended in a sequence one after the other which have the respectively greatest cross section or, when the telescopic rod is pushed together, the retraction is started with the rod section having the smallest cross section and subsequently the rod section with the next larger cross section can be pushed in.

Advantageously, the locking bars 8 and the catches 12 interacting with the locking bars 8 are arranged in pairs in the neutral zone of the telescopic rod. However, other embodiments are possible in which only one locking bar 8 and one catch 12 are provided for each rod section.

The invention is not limited by the embodiments described above which are presented as examples only but can be modified in various ways within the scope of protection defined by the appended patent claims.

I claim:

1. A telescopic rod comprising a plurality of tubular rod sections which are mounted so as to be telescopically axially slidable relative to each other between an extended position and a retracted position, the rod sections including a first outermost rod section, an inner rod section, and a plurality of intermediate rod sections between the outermost rod section and the inner rod section, a multistage piston-cylinder unit connected to the outermost rod section and to the inner rod section, the rod sections having inner end faces and outer end faces, locking bars being mounted at the inner end faces of the intermediate rod sections, an opening located in each rod section, wherein, when the telescopic rod is in the extended position, the locking bars are in positively locking engagement with the openings of each adjacent outer rod section, catches mounted at the inner end faces of the rod sections which are located inwardly adjacent the intermediate rod sections, the locking bars being moveable into and out of an unlocking position, wherein the catches hold the locking bars in the unlocking position when the telescopic rod is in the retracted position, spring-biased clamps mounted at the outer end faces of the intermediate rod sections, bolts provided at the outer end faces of the rod sections arranged inwardly adjacent the intermediate rod sections, wherein the clamps engage the bolts in a positively engaging manner when the telescopic rod is in the retracted position, spring-biased locking bolts being mounted at the inner end faces of the rod sections arranged outwardly adjacent the rod sections having the clamps, wherein the locking bolts engage the clamps and hold the clamps in a closed position when the telescopic rod is in the retracted position.

2. The telescopic rod according to claim 1, wherein each catch has an inclined surface at an end face thereof, each locking bar being biased by a spring, the locking bar having an abutting surface, wherein the catch rests against the abutting surface when the locking bar is the unlocking position and the telescopic rod is in the retracted position.

3. The telescopic rod according to claim 2, wherein the catches are tongue-shaped pins extending parallel to the longitudinal axes of the rod sections.

4. The telescopic rod according to claim 1, wherein the locking bars and the catches are arranged in a neutral zone of the telescopic rod.

5. The telescopic rod according to claim 1, wherein each clamp comprises a pair of two-armed jaws, wherein the jaws when the clamps are in a closed position define oblong holes extending in axial direction of the rod sections for receiving the bolts.

6. The telescopic rod according to claim 5, wherein each clamp comprises a compression spring mounted between the jaws for holding the clamps in the closed position, the jaws each having a pivoting axis, wherein the compression spring is mounted opposite the oblong recess relative to the pivoting axis of the jaws.

7. The telescopic rod according to claim 5, wherein a portion of the clamp having the oblong recess projects axially beyond the outer end face of the rod section.

8. The telescopic rod according to claim 6, wherein a portion of the clamp with the compression spring has a recess which is open toward the adjacent outer rod section, wherein the respective locking bolt engages the respectively adjacent recess when the telescopic rod is in the retracted position.

9. The telescopic rod according to claim 1, wherein the clamps and the locking bolts mounted for engagement with the clamps are arranged spaced apart in a circularly oriented direction.

10. The telescopic rod according to claim 1, wherein the locking bolts extend axially parallel to the longitudinal axes of the rod sections, and wherein the locking bolts are displaceable in axial direction against the force of a spring.

* * * * *